United States Patent [19]

Piveteau

[11] Patent Number: 4,887,542

[45] Date of Patent: Dec. 19, 1989

[54] DEVICE FOR AUTOMATICALLY SECURING A HOIST

[75] Inventor: Claude Piveteau, Anse, France

[73] Assignee: Wichard, Societe Anonyme of France, Thiers, France

[21] Appl. No.: 252,532

[22] Filed: Oct. 3, 1988

[30] Foreign Application Priority Data

Oct. 2, 1987 [FR] France ..... 87 14144

[51] Int. Cl.[4] ..... B63H 9/08

[52] U.S. Cl. ..... 114/108; 294/82.34

[58] Field of Search ..... 114/102, 104, 111, 108, 114/113; 294/82.34

[56] References Cited

U.S. PATENT DOCUMENTS 2,673,116 3/1954 Baird ..... 294/82.34 X 3,040,690 6/1962 Harless ..... 114/111

4,077,347 3/1978 Arce ..... 114/108

4,586,450 5/1986 Bernard ..... 114/108

*Primary Examiner*—Sherman D. Basinger

*Attorney, Agent, or Firm*—Browdy & Neimark

[57] ABSTRACT

A device for automatically securing in the hoist position the head of a sail of a sailing vessel on the mast of a vessel. The device comprises a body, one end of which is fitted with a device for securing the sail and the other end of which has passing through it a rod on which is fixed the halyard for handling the sail. In the body a hook is articulated, one arm of the hook projecting outwardly. A piston integrally formed with the rod is forced by a spring against the hook. When the piston is resting against the hook, the hook is locked, while in the opposite case the hook may pivot freely.

2 Claims, 2 Drawing Sheets

DEVICE FOR AUTOMATICALLY SECURING A HOIST

FIELD OF THE INVENTION

The present invention is a device for the automatic securing in the hoist position of the head of a sail of a sailing vessel to the mast of said sailing vessel.

BACKGROUND OF THE INVENTION

On a pleasure boat or a competition vessel the mainsail is guided in a rail disposed along the mast, where it is kept under tension when it is in the hoist position. This tension is applied to the sail in the first place by the halyard which permits the hoisting of it and in the second place, at the lower end of the sail, by a downhaul, generally composed of a pulley block with a plurality of sheaves. The halyard, which is attached by means of a spring hook or a shackle to an eye which is provided in the head of the sail, passes over a pulley pivotably mounted on the upper part of the mast and returns along the mast, on the interior or exterior of it as far as a winding and securing device.

During navigation the wind, which is the element propelling the boat, exerts a pressure on the entire sail. This pressure is represented by forces applied to the mast which may reach several hundreds of daN. These forces are applied to both the halyard and the downhaul. To prevent the halyard from becoming longitudinally stretched under the action of this pressure and reducing the tension applied to the sail halyards composed of stainless steel cables or of a synthetic material with a low coefficient of elongation, such as a material known under the name of KEVLAR, are generally used. Now, stainless steel halyards are difficult to use and Kevlar halyards are very costly and require careful handling.

It was therefore envisaged fixing at the mast head, as shown in FIGS. 1 and 2, a mounting 2 with a wing projecting from the mast 3. Between the head of the sail 4 and the halyard 5 actuating this there is interposed, in addition to a shackle 6 a piece 7 of the general shape of the letter S.

When the sail is fully hoist by means of the halyard 5, which passes over a pulley 8 disposed at the mast head, the piece 7 hooks onto the mounting 2 and assures that the sail is held in this position. The halyard, which then no longer has to exert a tensile force on the sail, may be made of a textile material or of an extensible synthetic material such as nylon.

The disadvantages of this system, which is shown in frontal and side view in FIGS. 1 and 2, is that it is difficult to detach the piece 7 from the mounting 2 to haul down the sail. It is necessary, in fact, first to pull on the halyard 5 to release the attaching means 7 from the mounting 2, and then to pull laterally on the sail, or, if possible, to rotate the mast to bring the piece 7 beside the mounting 2. This is a delicate operation which limits considerably the use of this type of device.

SUMMARY OF THE INVENTION

The present invention aims at remedying these inconveniences by providing an automatic device which makes it possible to attach the head of a sail to and to detach it from a mounting fixed to the mast.

For this purpose this device comprises a body of elongated shape, one end of which has a means of attaching the sail and from the other end of which a shank projects which, equipped with a ring for the attachment of the halyard for handling the sail, is integrally formed with a piston mounted to slide axially in the body and subjected to the action of a spring pushing it in the direction of the first said end, this body comprising a laterally open part communicating directly with the bore in which the piston is mounted, in which part there is mounted so as to pivot about a transverse axis a hook at least one of the branches of which projects towards the exterior, this hook being shaped in such a way that when the piston is resting against it the rotation of its outer arm in relation to the body is locked and forms with this body an acute angle on the side of the end of the body provided with means of attachment to the sail, and that when the piston is withdrawn it is able to pivot freely and to form an obtuse angle with the body.

To hoist the sail, the navigator pulls the halyard, at the end of which is fixed the said head with the securing device interposed. The assembly is hoisted in this way to the top of the mast, the hook in the low position passing along the mounting secured to the mast.

The operator then releases the halyard and the piston-spring assembly of the device locks the hook into a position in which the arm of it projecting from the body is turned downwards. This arm then locks behind the mounting. By leaving the halyard slightly untensioned the navigator can regulate his sail by adjusting the tension of the downhaul.

When the navigator is required to lower the sail, he pulls on the halyard 5, which results in an upward displacement of the piston installed inside the securing device against the action exercised by the spring. The piston then releases the spring, which is able to pivot freely. The tension of the sail raises the hook, which swings upwards and escapes from the mounting attached to the mast. The sail can be lowered, the release of the halyard causing the device to return to its initial position in which the piston locks the hook.

The hook conveniently comprises, in the zone of it located inside the body and on the side turned toward the piston, a flat surface for the support of the end of it forming with the axis of the arm of the hook an angle supplementary to that which the arm forms with the body in the engaged position.

According to one embodiment of this device, the flattened surface is delimited on the side of the arm of the hook projecting outwards by a shoulder which is substantially perpendicular to it and extended by a ramp in the general shape of an arc of a circle.

In this way, when the tension exerted on the piston is released, the piston is supported on the ramp of the hook, causing this to pivot until the piston comes to rest against the flat surface.

BRIEF DESCRIPTION OF THE DRAWINGS

In any case, the invention will be clearly understood by means of the description which follows, with reference to the appended diagrammatic drawing which shows, by way of non-limiting example, one embodiment of this device.

DETAILED DESCRIPTION OF THE INVENTION

Figure 1:
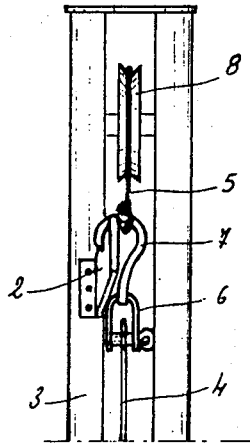
FIGS. 1 and 2 illustrate the prior art.
Figure 2:
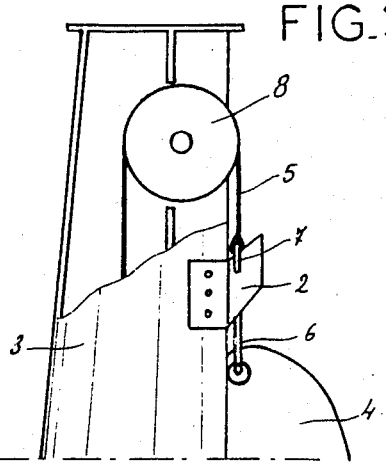
Figure 3:
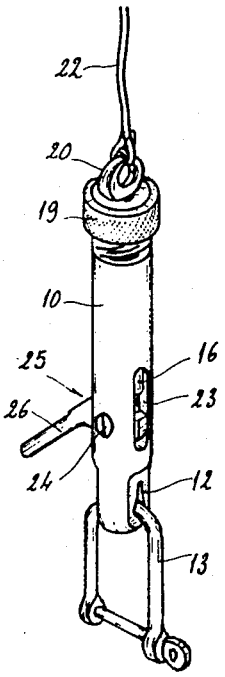
FIG. 3 is a perspective view of the device according to the present invention.

The device shown in the drawing comprises a body 10 of elongated shape, in one end of which an eye 12 is provided for the passage of a shackle 13 or the like, which is intended to be engaged in an eye 14 provided in the head of the sail 4.

The body 10 has a tubular part in which is provided a bore 15 serving to guide a piston 16. This piston 16 is integrally formed with a rod 17 of reduced cross-section, around which is engaged a helicoidal spring 18 which is supported on the one hand on the piston 16, and on the other hand on a stop 19 screwed onto the corresponding end of the body.

The free end of the rod 17 is fitted with a ring 20 which permits the attachment of a halyard 22. At the end of the bore 15 located on the side of the middle of the device is provided an opening 23, in which is mounted to pivot about an axis 24 at right-angles to the body a hook 25, one arm of which projects outwards.

This hook has on its face opposite the piston 16 a flat surface 27 which, when the piston is resting on it, locks the hook in a piston in which the arm 26 forms an acute angle with the axis of the body and is turned downwards.

It should be noted that the flat surface 27 is delimited on the side of the arm 26 by a shoulder 28 which is substantially at right-angles to it, this shoulder 28 being extended on the side of the arm 26 by a part 29 in the form of a ramp in the general shape of an arc of a circle.

The operation of this device is as follows.

Figure 4:
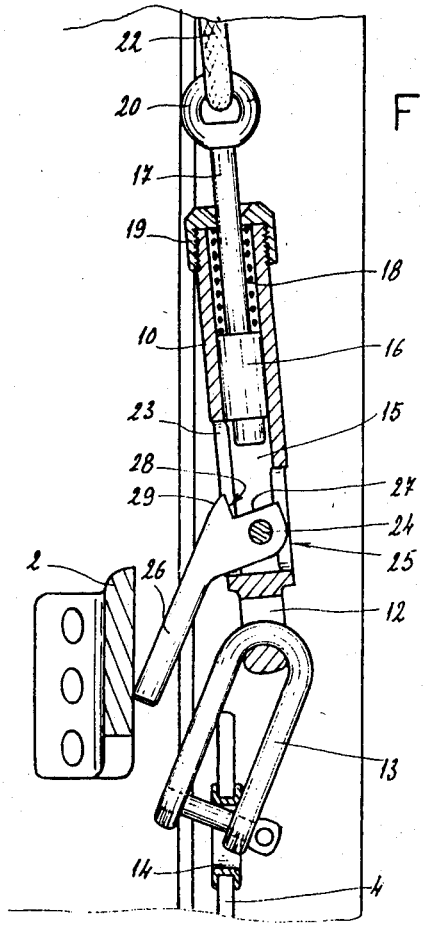
FIGS. 4 to 6 are three longitudinal sectional views, on a larger scale, before hooking, after hooking and after the release of the device respectively.
Figure 5:
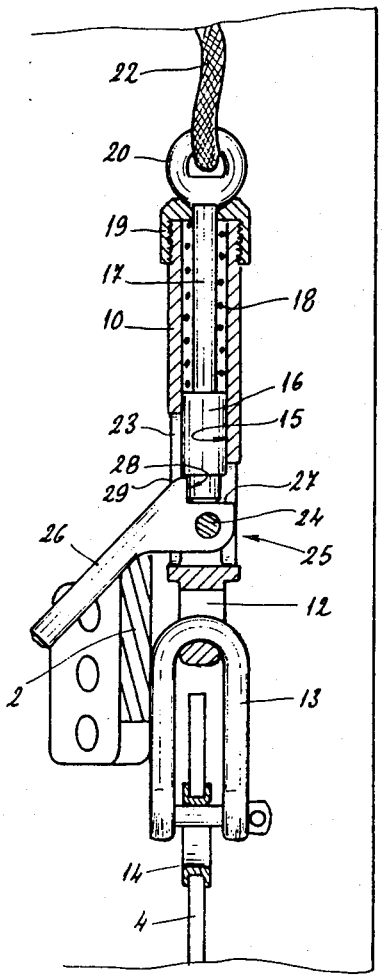

When the operator hoists the sail, the traction exerted on the halyard 22 causes the piston 16 to recoil against the action of the spring 18, so that the hook 28 is unlocked. However, under the action of gravity the arm 26 of the hook remains directed downwards, as can be seen from FIG. 4. When the sail reaches the hoist position and the arm 26 has passed the mounting 2 secured to the mast, the operator releases the traction exerted on the halyard, so that the piston 16 locks the hook 25, the arm 26 of which engages behind the mounting 2, as shown in FIG. 5. The sail is thus fixed in the hoist position, the halyard no longer playing any part.

Figure 6:
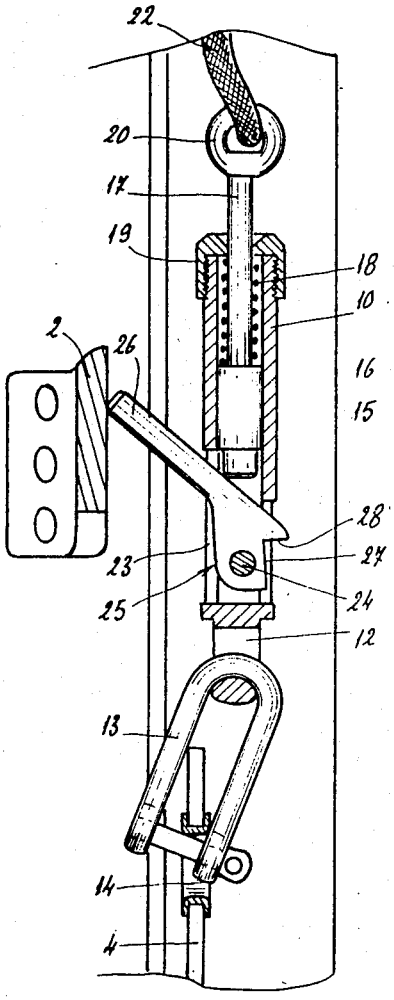

To lower the sail it is difficult for the user to exert a tractional force on the halyard 22, which results in a displacement of the piston 16 against the action of the spring 18, bringing about the unlocking of the hook 25. This hook being free, its arm 26 pivots upwards under the action of the tension of the sail and escapes from the mounting 2, as is shown in FIG. 6. The sail can then be lowered freely by releasing the halyard, the piston again coming to rest on the hook and relocking it.

As can be seen from the foregoing remarks, the invention brings a great improvement to the existing technique by providing an automatic device for locking a sail in the hoist position which is very simple in conception and in use.

As is obvious, the invention is not limited merely to the embodiment of this device described above by way of example; it covers, on the contrary, all variant models. Thus, in particular, this device might comprise a hook of a different shape or a double hook, the spring producing the movement of the piston might be disposed differently, and in particular outside the body, the securing mountings might be disposed differently, for example incorporated with the bolt-rope or incorporated with the mast, or else this device might be used to hold in the hoist position not the mainsail, but another sail such as a genoa, without, however, going beyond the scope of the invention. The simplicity of this device also makes it possible to envisage the securing on the mast at successive levels a plurality of mountings, which makes it possible to secure the head of the sail at various levels with a view to adapting the sheet area to the wind strength.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A device for the automatic securing in the hoist position of the head of a sail of a sailing vessel on a mounting integrally formed with the mast, said device comprising:

a body of elongated shape, said body having a first end and a second end;

said first end having a means for securing a sail;

a rod projecting from said second end of said body;

said rod provided with a ring to secure a halyard for handling the sail;

said rod formed integrally with a piston mounted to slide axially in said body, said piston subjected to the action of a spring adapted and constructed to push said piston in the direction of said first end of said body and to engage a hook;

said body also including a part which is open at the side thereof and in communication with a bore in which said piston is mounted;

said hook having at least one arm mounted in said part in such manner as to pivot about a transverse axis and an outer branched which projects outwardly from said body;

said hook comprising, in the portion of said hook located inside said body, and on the portion thereof engaged by said piston, a flat surface adapted and constructed to support the end of said piston, forming with the axis of the arm of the hook an angle supplementary to that angle formed by said branch with the body in the hooked position;

said flat surface being delimited on the side of the arm of said hook projecting outwardly by a shoulder which is substantially at right angles to said arm, said shoulder being extended by a ramp in the general shape of an arc of a circle;

said one arm of said hook shaped so that when said piston is engaged against said hook, said outer branch of said hook is blocked in its rotation in relation to said body and forms with this an acute angle on the side of said first end of said body so that when said piston is withdrawn it can pivot freely and form an obtuse angle with said body.

2. The device according to claim 1 wherein the rod integrally formed with the piston has a cross-section less than that of the piston which passes through a screwed stop forming the body from which said rod projects, said spring being a helicoidal spring having a first end and a second end, said spring being engaged on said rod, the first end of said spring resting against said stop and said second end of said spring resting against said piston.

* * * * *